US009909293B2

(12) United States Patent
Winter et al.

(10) Patent No.: US 9,909,293 B2
(45) Date of Patent: Mar. 6, 2018

(54) PORTABLE TOILET

(76) Inventors: Ken Winter, Innisfil (CA); Roger Winter, Innisfil (CA)

( * ) Notice: Subject to any disclaimer, the term of this patent is extended or adjusted under 35 U.S.C. 154(b) by 1261 days.

(21) Appl. No.: 13/507,603

(22) Filed: Jul. 13, 2012

(65) Prior Publication Data

US 2014/0013502 A1 Jan. 16, 2014

(51) Int. Cl.

| | |
|---|---|
| ***A47K 4/00*** | (2006.01) |
| ***E03D 7/00*** | (2006.01) |
| ***E04H 1/12*** | (2006.01) |

(52) U.S. Cl.

CPC ..... *E03D 7/00* (2013.01); *E04H 1/1266* (2013.01)

(58) Field of Classification Search

USPC ..... 4/663, 664, 665, 476, 477

See application file for complete search history.

(56) References Cited

U.S. PATENT DOCUMENTS

| | | | | |
|---|---|---|---|---|
| 456,073 | A * | 7/1891 | White | 4/303 |
| 4,238,858 | A * | 12/1980 | Maihart | 4/546 |
| 4,490,863 | A * | 1/1985 | Pate | 4/301 |
| 6,115,971 | A * | 9/2000 | Loebertmann et al. | 52/79.1 |
| 6,681,413 | B2 * | 1/2004 | Weiss | 4/476 |

* cited by examiner

*Primary Examiner* — Huyen Le

(57) ABSTRACT

A portable toilet particularly suited to be a roll-out toilet positions a toilet with its holding tank at a rear wall, a sink at an opposed front wall, a urinal on one of the side walls and an access door through the opposing sidewall to provide access to the enclosure formed by the, front, rear and side walls. By connecting the drain from the sink to the urinal so that the water draining from the sink must pass through the urinal and then pass from the urinal to a toilet holding tank via a drain line connecting the urinal to a toilet holding tank the sink drain water is collected and will tend to wash and thereby clean the urinal.

3 Claims, 4 Drawing Sheets

PORTABLE TOILET

FIELD OF INVENTION

The present invention relates to an improved toilet more particularly an improved roll-out toilet that can pass through standard doors and contains a toilet, separate urinal and a sink.

BACKGROUND OF THE PRESENT INVENTION

Portable toilets generally are formed with an entry door through a front wall, a toilet at the opposite end (rear wall end), a sink on one of the side walls connecting front and rear walls and a urinal on the other (opposite to the sink) side wall.

A Roll-out portable toilet is a general named used in the trade to refer to a specific form of portable toilets that is mounted on wheels and is sufficiently narrow in one dimension to pass through standard door i.e. usually designed to pass through a 30 inch door. Roll-out toilets as currently available comprise an open top container or enclosure having an entry door on the front narrow end and a toilet opposite the door at the narrow rear end of the container. These roll out portable toilets cannot properly accommodate a sinks so sinks are not provided. A urinal is provided in known portable roll-out toilets by a passage from the outside through the narrow rear wall and emptying into the toilet's holding tank and is used by standing outside the container or enclosure at the rear and urinating into the passage. These devices do not meet modern requirements.

The present invention overcomes these problems and improves the operation of urinals of the type generally used in portable toilets and enables the inclusion of a urinal in a roll-out toilet.

BRIEF DESCRIPTION OF THE PRESENT INVENTION

It is an object of the present invention to provide an improved portable toilet with a self cleaning urinal feature and to provided an improved roll-out toilet wherein the toilet, sink and urinal are positioned within the housing Broadly the present invention relates to a portable toilet comprising a front wall, a rear wall opposite said front wall and a first side wall and a second side wall forming a pair of opposed side walls interconnecting said front and rear wall to define an enclosure, a toilet adjacent to said rear wall, a sink adjacent to said front wall a urinal adjacent to said first side wall and an access door through said second side wall to provide access to said enclosure.

Preferably, a first drain line extends from said sink and drains into a side of said urinal adjacent to said sink and a second drain line extends from a side of said urinal remote from said one side and drains into a holding tank of said toilet so that water draining from said sink passes through said urinal to wash said urinal and then into said holding tank.

Preferably, sad enclosure is mounted on wheels and said front and rear walls are of a width X and said first and second side walls have a length Y and wherein said length Y is longer than said width X, said width X is a width that can pass through conventional door sizes and provide a roll-out portable toilet.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
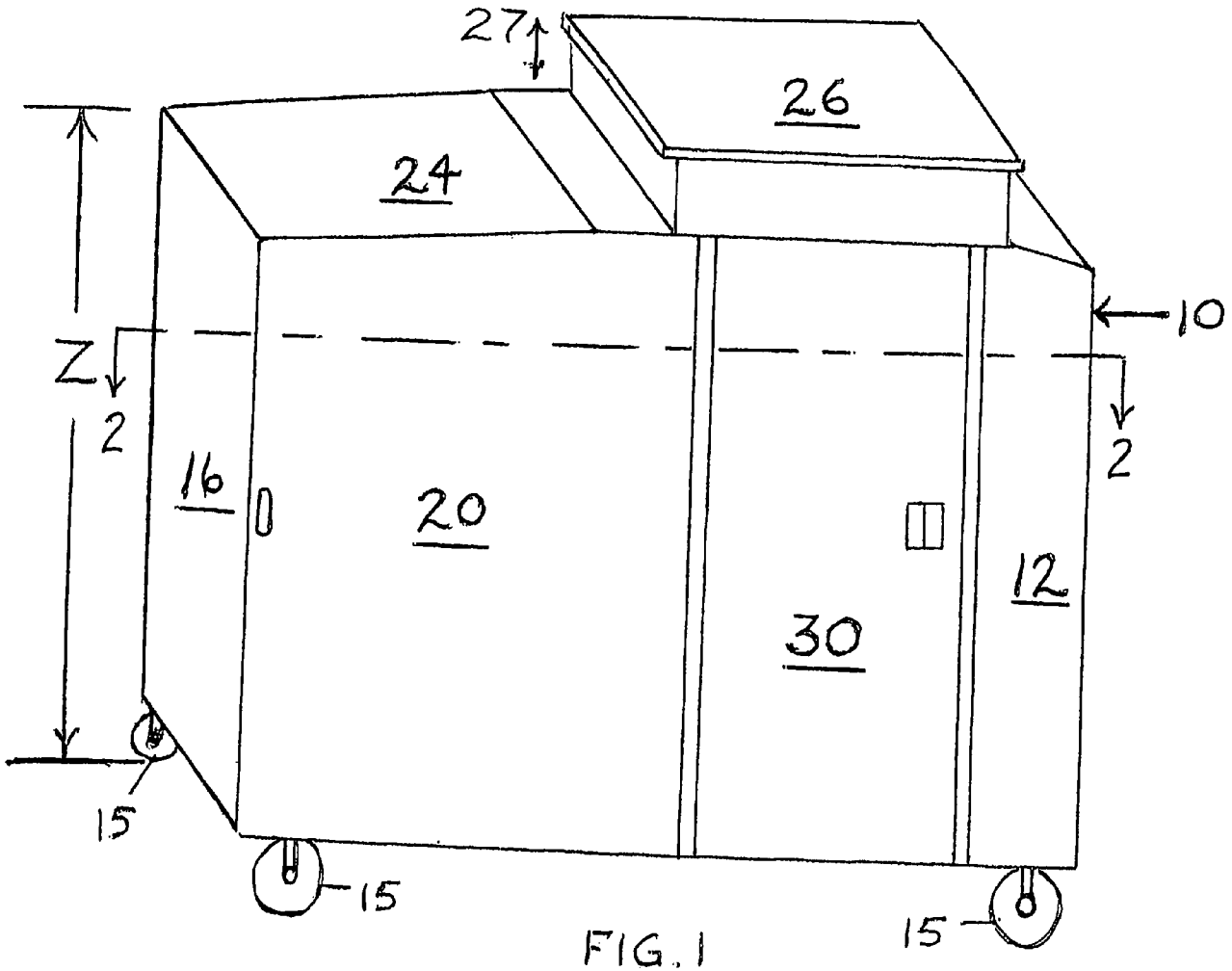
FIG. 1 is a schematic isometric illustration of a portable toilet of the present invention.
Figure 2:
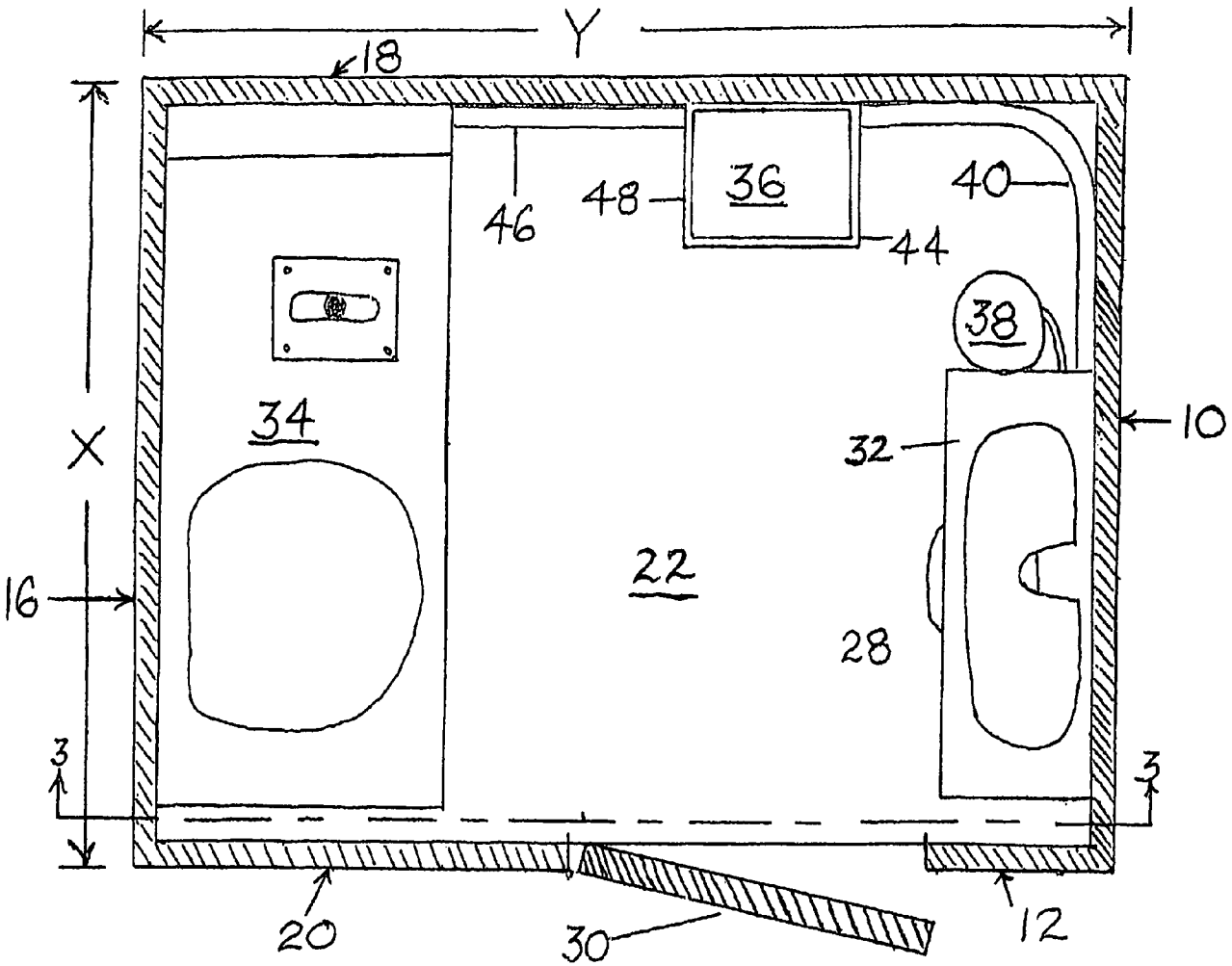
FIG. 2 is a plan view showing the layout of the enclosure i.e. section on the line 2-2 of FIG. 1

As shown in FIGS. 1 and 2 the portable toilet 10 of the present invention includes an enclosure 12 having its periphery defined by a front wall 14, rear wall 16, a first side wall 18, a second side wall 20 opposite the first side wall 18 which in the illustrated arrangement combine to define the periphery of the enclosure 12. A bottom wall or floor 22 and a top wall or roof completes the boundaries of the enclosure 12.

Figure 3:
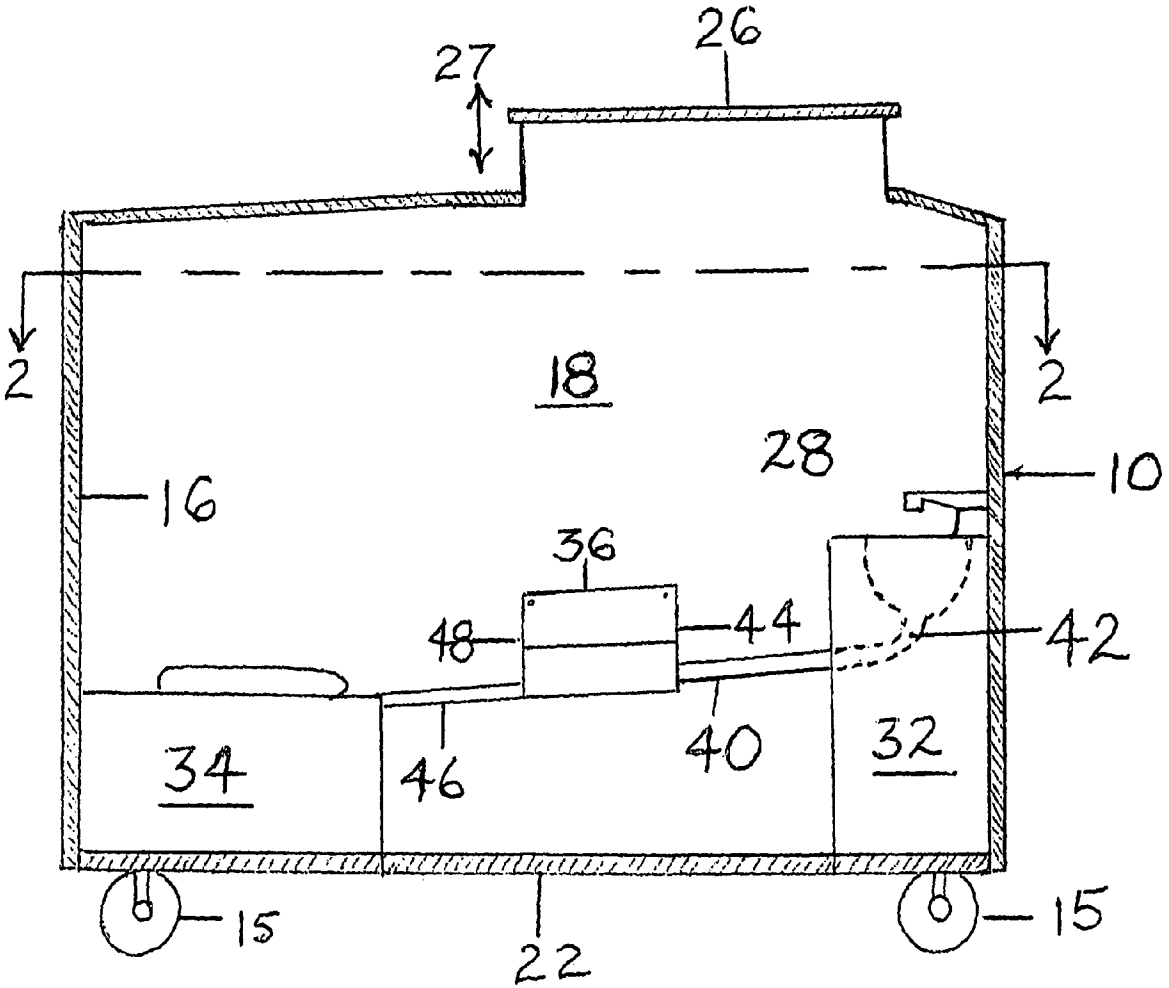
FIG. 3 is a side elevation showing the layout in the enclosure i.e. a section on eh lines 3-3 of FIG. 2.
Figure 4:
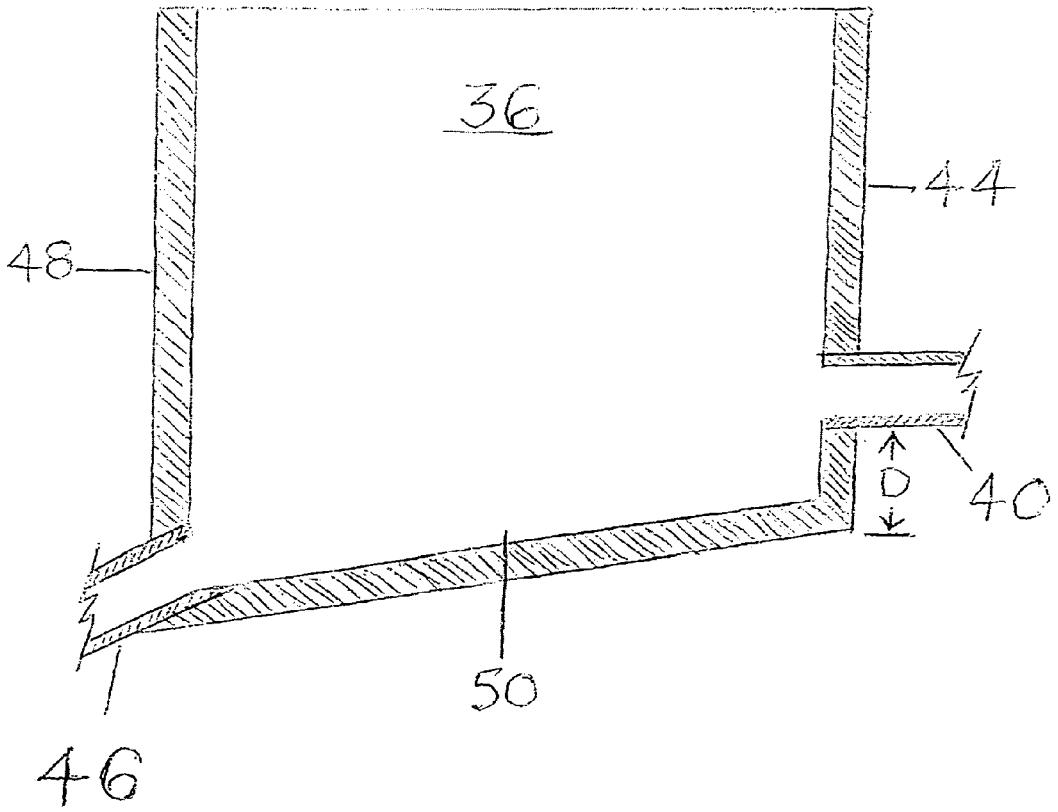
FIG. 4 is a section through the urinal showing the inlet and outlet positions relative to the bottom of the urinal.

A pop-up top 26 that in the up position shown in FIGS. 1 and 3 accommodates a user in standing position but when lowered as indicated by the arrow 27 to a down position reduces the toilet height to a height Z that permits passage through standard door sizes.

Access to the interior 28 of the enclosure 12 is provided via the access door 30 hinged onto the second side wall 20.

To provide a roll out toilet the enclosure 12 is mounted on wheels 15 one at each of the four corners of the bottom 22 of the enclosure 12 and is constructed so that the width X of the enclosure 12 (width of the narrower walls 14 and 16) is narrow enough to pass through a standard door width, the length Y of the enclosure 12 as defined by the length of side walls 18 and 20 may be of any suitable length but will normally be longer than X, and the height Z of the enclosure 12 from the side of the wheels 15 remote from the bottom 22 to the top (highest point of the enclosure 12 with the pop-up top 26 in lowered position) is sufficiently short that it can pass through a standard door height.

The interior 28 has a sink 32 mounted adjacent to the front wall 14 and a toilet including a holding tank 34 positions opposite the sink 32 and adjacent to the rear wall 16. A urinal 36 (having a shorter front wall than the rear backsplash wall as is known), opposite the door 30 and about mid way between the sink 32 and the toilet 36. The sink 32 may be any be of any suitable construction but will preferably will comprise a conventional sink and fresh water supply tank (not shown) and a water heater 38 preferably of the type shown in U.S. Pat. No. 6,628,894 issued Sep. 30 2003 to Winter et al. (corresponding with Canadian Patent no. 2,351,910) The enclosure may also be provided with a heater and lighting where required. A drain line 40 connects the sink drain 42 (shown in dash lines in FIG. 3) with one side 44 of the urinal 36 and a second drain line 46 connects the side 48 of urinal 36 remote from the side 44 to the holding tank of toilet 34. The liquid (used water) draining from the sink drain 42 passes through the drain line 40 into the urinal 36 through the wall 44 and flows along the bottom 50 of the urinal and out through the wall 48 adjacent to the bottom 50 and into drain line 46 to then flow into the holding tank 34.

This flow of waste water from the sink 32 through the urinal 36 tends to wash and thereby clean the urinal. Preferably the inlet through the wall 44 will be at least ½ inch higher than the outlet through the wall 48 as indicated by the dimension D. Obviously the height of the drain 42 urinal 36 and tank 34 will be progressively lower so that water will flow from the sink down line 40 to urinal 36 and down line 46 into toilet tank 34.

Having described the invention, modifications will be evident to those skilled in the art without departing from the scope of the invention as defined in the appended claims.

We claim:

1. A portable toilet comprising a front wall, a rear wall opposite said front wall and a first side wall and a second side wall forming a pair of opposed side walls interconnecting said front and rear wall to define an enclosure, a toilet having a holding tank adjacent to said rear wall, a sink adjacent to said front wall, a urinal adjacent to said first side wall and an access door through said second side wall to provide access to said enclosure wherein a first drain line extends from said sink and drains into one a side of said urinal adjacent to said sink and a second drain line extends from a side of said urinal remote from said one side and drains into a holding tank of said toilet so that water draining from said sink passes through said urinal to wash said urinal and then into said holding tank.

2. A portable toilet as defined in claim 1 wherein sad enclosure is mounted on wheels and said front and rear walls are of a width X and said first and second side walls have a length Y and wherein said length Y is longer than said width X, said width X being a width that can pass through conventional door sizes and provide a roll-out portable toilet.

3. A portable toilet as defined in claim 1 wherein sad enclosure is mounted on wheels and said front and rear walls are of a width X and said first and second side walls have a length Y and wherein said length Y is longer than said width X, said width X being a width that can pass through conventional door sizes and provide a roll-out portable toilet.

* * * * *